US007017899B2

(12) United States Patent
Romita et al.

(10) Patent No.: US 7,017,899 B2
(45) Date of Patent: Mar. 28, 2006

(54) REMOVABLE PORTION FORMAT

(75) Inventors: John Romita, Lockport, IL (US); William Castillo, Bolingbrook, IL (US)

(73) Assignee: Lehigh Press, Inc., Broadview, IL (US)

( * ) Notice: Subject to any disclaimer, the term of this patent is extended or adjusted under 35 U.S.C. 154(b) by 0 days.

(21) Appl. No.: 10/974,344

(22) Filed: Oct. 27, 2004
(Under 37 CFR 1.47)

(65) Prior Publication Data

US 2005/0200068 A1 Sep. 15, 2005

Related U.S. Application Data

(60) Provisional application No. 60/553,368, filed on Mar. 15, 2004.

(51) Int. Cl.
*B41F 13/56* (2006.01)
*B65B 11/48* (2006.01)

(52) U.S. Cl. ..... 270/5.02; 270/21.1; 53/206

(58) Field of Classification Search ..... 270/4, 270/5.01, 5.02, 5.03, 10, 20.1, 21.1; 53/203, 53/206, 450, 461, 548, 550, 553; 283/100, 283/101
See application file for complete search history.

(56) References Cited

U.S. PATENT DOCUMENTS

| | | | | |
|---|---|---|---|---|
| 3,808,768 | A * | 5/1974 | Dobbs | 53/460 |
| 4,063,398 | A | 12/1977 | Huffman | |
| 4,071,997 | A | 2/1978 | Gunther, Jr. et al. | |
| 4,189,895 | A | 2/1980 | Volkert et al. | |
| 4,215,626 | A * | 8/1980 | Giulianotto | 493/278 |
| 4,455,809 | A | 6/1984 | Dallaserra | |
| 4,769,969 | A | 9/1988 | Minami | |
| 4,790,119 | A | 12/1988 | McDaniels | |
| 5,137,304 | A | 8/1992 | Silverschotz et al. | |
| 5,160,022 | A | 11/1992 | Mennella | |
| 5,417,458 | A | 5/1995 | Best et al. | |
| 5,776,287 | A | 7/1998 | Best et al. | |
| 6,070,391 | A | 6/2000 | Honegger | |
| 6,315,023 | B1 | 11/2001 | King et al. | |
| 6,658,817 | B1 | 12/2003 | Eve et al. | |
| 6,712,398 | B1 | 3/2004 | Fox et al. | |
| 2003/0028439 | A1 | 2/2003 | Cox et al. | |
| 2005/0006445 | A1 | 1/2005 | Katz | |

FOREIGN PATENT DOCUMENTS

| | | |
|---|---|---|
| WO | WO 92/00878 A1 | 1/1992 |
| WO | WO 03/095114 A1 | 11/2003 |

* cited by examiner

*Primary Examiner*—Ren Yan
(74) *Attorney, Agent, or Firm*—Trexler, Bushnell, Giangiorgi, Blackstone & Marr, Ltd.

(57) ABSTRACT

A system for producing removable portions for mass-distributable packets by single-pass manufacturing, in which a printed web is slit into two ribbons, one of which is then folded upon itself to create a multi-ply ribbon that appears to be of heavier stock than the original paper. Alternatively, the multi-ply ribbon can be created by gluing together multiple ribbons, or by a combination of folding ribbons and gluing together ribbons. The multi-ply ribbon is die cut into an inside portion and an outside portion and married to the other ribbon, after which the outside portion is removed, leaving the inner portion as removable portions. Alternatively, the folded ribbon can be kiss cut after it has been married to the other ribbon. The removable portions can be UV-coated to simulate plastic and printed with information personalized for the advertiser or for the recipient.

22 Claims, 6 Drawing Sheets

REMOVABLE PORTION FORMAT

PRIORITY

This application claims the benefit of U.S. Provisional Application No. 60/553,368, filed on Mar. 15, 2004.

FIELD OF THE INVENTION

This invention is generally directed to an in-line finishing system for manufacturing a heavier-stock, removable portion, to incorporate in a mass-distributable packet, in a single-pass manufacturing process, using no premanufactured portions.

BACKGROUND OF THE INVENTION

Advertisers commonly use mass-distributable packets to promote their products. These packets are distributed by mail, by insert into newspapers or other periodicals, by hand delivery, or otherwise.

Advertisers often wish to include a removable portion in the advertising materials. A removable portion is generally a piece of smaller dimensions than the packet, and is usually printed on a heavier stock. A removable portion can take the form of, by way of example and not by way of limitation, a facsimile credit card in a credit card advertisement; a discount card, such as for a certain dollar amount or certain percentage off the price of merchandise or services; a gift card; a loyalty card; or a temporary membership card for an organization such as a health club. Either the packet or the removable portion can be personalized in a variety of ways as is known in the art.

Removable portions are often used for promotional purposes in advertising, but can be used for other purposes and the present invention as described herein is not limited to removable portions used in advertising. For example, an organization could use the present invention to prepare actual membership cards.

One variety of the current practice calls for printing mass-distributable packets on a web press. The packets are prepared by printing the information to appear on the packets in a plurality of longitudinal areas extending parallel to the web, cutting the web longitudinally between the print patterns to form ribbons, superimposing the cut ribbons in a vertical registry, and then cutting the ribbons transversely to form the sets of printed pieces. The ribbons can be folded and cut in a variety of ways to create many different forms.

Because the removable portion is usually of a heavier stock paper than the advertising materials, the removable portion cannot be easily printed on the same web press at the same time as the advertising materials. Therefore, removable portions are printed separately, by known methods, and added to the packet in a "tip on" process. Accordingly, a separate printing apparatus is needed, either a web press or other printing machine, or an outside vendor must print the removable portions separately. The removable portions sometimes can be printed on the same web press that prints the packets, but not at the same time, since the removable portion is of a heavier stock than the main packet. Some printing equipment cannot print paper of the thickness desired for a removable portion, to a separate press is required, either in-house or at an outside vendor.

Problems arise in this current method of manufacture. Utilizing a second printing apparatus for the removable portion adds capital expense and labor costs. Using an outside vendor adds costs and creates quality control problems. Regardless of who prepares the removable portions or where the removable portions are printed, the tip-on process can cause alignment problems and increase make-ready time. Placing the preprinted removable portions in precise alignment on the advertising packets is difficult. The alignment problem is exacerbated if there is a need to turn the web to an upward angle in order to introduce a fold in the packet, after the removable portion has been married to the web.

Accordingly, there is a need for a less expensive, easily set up, single-pass system that minimizes the alignment problems and make-ready time for adding a removable portion to a packet of printed materials. The present invention meets this need.

OBJECTS AND SUMMARY OF THE INVENTION

A general object of the present invention is to provide a continuous single-pass finishing system for production of mass-distributable packets of printed materials and removable portions.

Another object of the present invention is to provide a continuous single-pass finishing system for production of mass-distributable packets of printed materials and removable, multi-ply portions.

Another object of the present invention is to provide a continuous single-pass finishing system for production of mass-distributable packets of printed materials and removable portions, with information personalized to the advertiser or to the recipient printed on the removable portions.

Yet another object of the present invention is to provide a continuous single-pass finishing system for production of mass-distributable packets of printed materials and removable, multi-ply portions, with information personalized to the advertiser or to the recipient printed on the removable portions.

Briefly, and in accordance with the foregoing, the present invention discloses a system for slitting a web coming out of a printing press into at least a first ribbon and a second ribbon, whereby the first ribbon will become the packets of printed materials and the second ribbon will become the removable portions; applying an adhesive to one side of the second ribbon; folding the second ribbon upon itself at least once to form a multi-ply ribbon; die cutting the multi-ply ribbon to form inner portions and outer portions; applying spot glue; marrying the multi-ply ribbon to the first ribbon; and pulling off the outer portion, leaving the removable portion married to the first ribbon.

In another embodiment, the present invention discloses a system for slitting a web coming out of a printing press into at least a first ribbon, a second ribbon, and a third ribbon, whereby the first ribbon will become the packets of printed materials and the second ribbon and third ribbon will become the removable portions; applying an adhesive to one side of either the second ribbon or the third ribbon; marrying the second ribbon to the third ribbon to form a multi-ply ribbon; die cutting the multi-ply ribbon to form inner and outer portions; applying spot glue; marrying the multi-ply ribbon to the first ribbon; and pulling off the outer portion, leaving the removable portion married to the first ribbon.

In yet another embodiment, the present invention discloses a system for slitting a web coming out of a printing press into at least a first ribbon, a second ribbon, and a third ribbon, whereby the first ribbon will become the packets of printed materials and the second ribbon and third ribbon will become the removable portions; applying an adhesive to one side of the second ribbon; folding the second ribbon upon itself while sandwiching the third ribbon inside the fold of the second ribbon, to form a multi-ply ribbon; die cutting the multi-ply ribbon to form inner and outer portions; applying spot glue; marrying the multi-ply ribbon to the first ribbon; and pulling off the outer portion, leaving the removable portion married to the first ribbon.

In yet another embodiment, at least one of the ribbons is coated with a UV underlayment to simulate the appearance of plastic.

In yet another embodiment, personalized information is printed on the removable portion or elsewhere.

In yet another embodiment, two parallel web presses are used to print two separate webs. The output of one web press is used to create a multi-ply ribbon, as described above. The output of the other web press is used to create the packets. The multi-ply ribbon is married to the second web, as described above, and the outer portion is removed, as described above.

In yet another embodiment, two separate webs are printed on the same web press at the same time. The first web is used to create a multi-ply ribbon, as described above. The second web is used to create the packets. The multi-ply ribbon is married to the second web, as described above, and the outer portion is removed, as described above.

In yet other embodiments, the present invention discloses a system whereby the multi-ply ribbon, as described above, is married to the second ribbon and then kiss cut into inner and outer portions. The outer portion is removed, as described above.

Mass-distributable packets of inserts with outer wraps can already be made in one continuous manufacturing process, using no premanufactured portions. The present invention can be used to incorporate a removable portion into such a mass-distributable advertising packet in a single-pass system, with greatly reduced alignment problems.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1A:
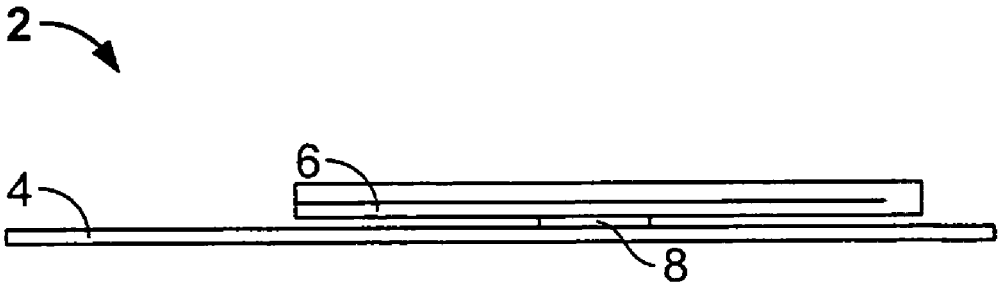
FIG. 1A is an elevation view of a packet containing a removable portion as made in the preferred embodiment of the present invention.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 1B:
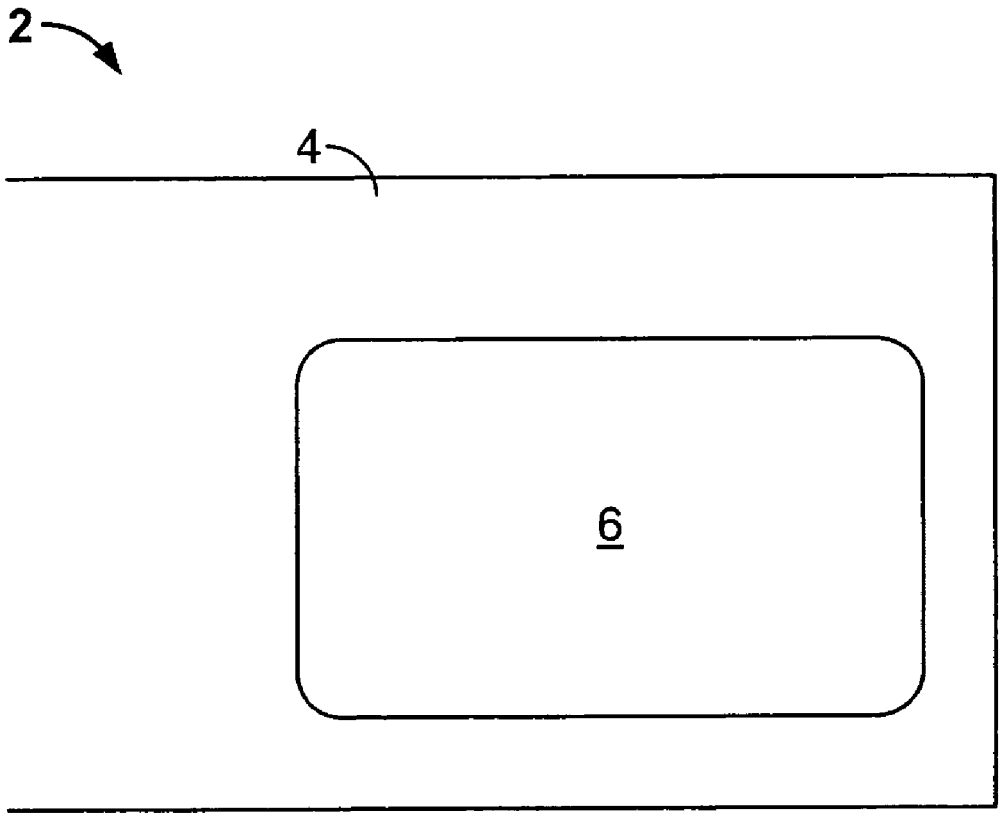
FIG. 1B is a plan view of a packet containing a removable portion as made in the preferred embodiment of the present invention.

FIGS. 1A and 1B show a sample packet 2 with a main portion 4 and a removable portion 6, as printed by the method of the preferred embodiment of the present invention. The removable portion 6 adheres to the main portion 4 by means of spot glue 8. Please note that FIGS. 1A and 1B illustrate a simple embodiment of a sample packet 4. The web 10 as hereinafter described can be folded in a myriad of ways before or after the removable portion 6 is added to the main portion 4 to produce a packet 2, in ways well known in the art. Additionally, FIG. 1A illustrates a simple two-layer or two-ply removable portion, but a removable portion with three or more layers can also be made using the present invention. Thus, in the illustrated example, if main portion 4 is a brochure printed on seven-point paper (0.007 inch thick), the removable portion 6 will appear to the recipient to have been printed on 14-point paper (0.014 inch thick), even though both the brochure 4 and the removable portion 6 were printed on the same seven-point paper.

Figure 2:
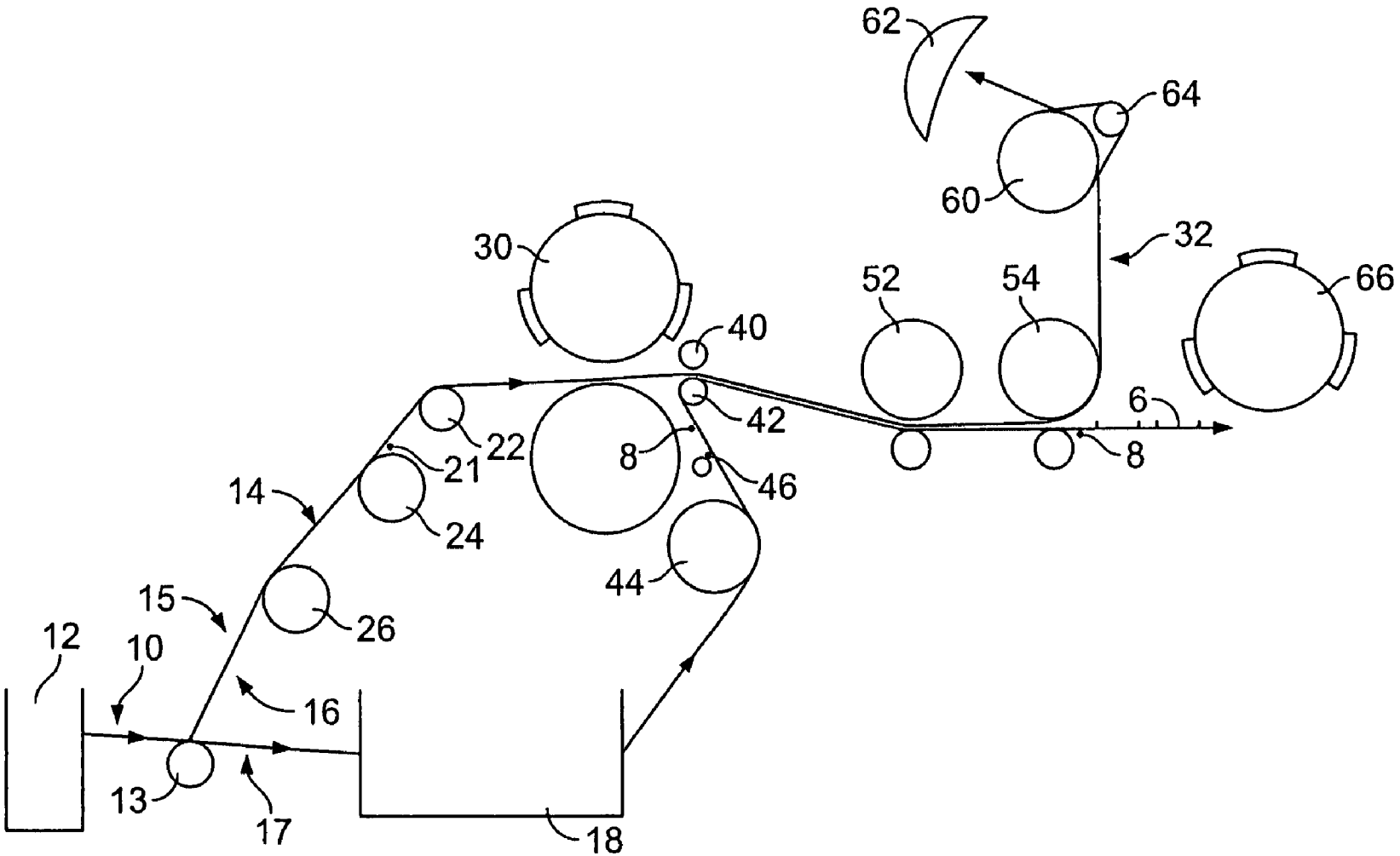
FIG. 2 is an elevation view of the finishing system that incorporates the features of the preferred embodiment of the invention.

The information to be provided on the packet 2 is printed on a web of paper 10 in a standard web press 12, as shown in FIG. 2. A slitter 14 cuts the printed web 10 into an upper ribbon 16 comprising what will become the removable portions 6 in the example method shown and a lower ribbon 18 comprising what will become the main portion 4 of the packet 2 in the example method shown. Please note that the web 10 can first be slit into numerous pairs of ribbons, each pair of which becomes upper ribbon 16 and lower ribbon 18 as described herein. Moreover, the following description is of a simple two-ribbon embodiment, but the principles of the invention are adaptable to multiple-ribbon applications.

Please note that the lower ribbon 18 can be slit, folded, glued, and cut in a variety of ways in processing stations 20A before it is cut into packets 2, to create any number of variations of packet 2, depending on the number and type of packet 2 desired.

In the example method shown, the upper ribbon 16 has a printed side 22 and a non-printed side 24. The upper ribbon 16 is rolled over an applicator 26 that applies adhesive 28 to the non-printed side 24 of the upper ribbon 16. The upper ribbon 16 is then folded upon itself by a plow 30 to become a multi-ply ribbon. In the illustrated embodiment, the upper ribbon 16 is folded upon itself once, so that the upper ribbon 16 now has twice the thickness of the original paper. Additionally, the upper ribbon 16, having been folded in half, with printed side 22 to the outside, now has printed information on both sides. Thus, in the illustrated embodiment, the upper ribbon 16, which will be cut into removable portion 6, appears to be twice the thickness of the lower ribbon 18 and has information on both sides. More plows can be added in any combination to fold the upper ribbon 16 to create triple ply, quadruple ply, or higher order thicknesses. Because the upper ribbon 16 is folded to create multiple layers, the finished removable portions 6, as will hereinafter be described, appear to be of heavier stock than the rest of the packets 2 to which the removable portions 6 are attached, even though the removable portion 6 and packet 2 were both originally printed from the same web 10.

In another embodiment, other finishing operations are applied to upper ribbon 16. For example, a coating, such as a UV underlayment, may be applied to the upper ribbon 16 at coating station 32. A UV underlayment will provide a slick appearance to the removable portion 6 and simulate plastic. Thus, for example, a temporary membership card sent in an advertising packet for a health club will have the appearance of a permanent plastic membership card. Please note that coating station 32, shown in the preferred embodiment located after slitter 14, can alternatively be placed before slitter 14, after plow 30, or elsewhere. Other coatings can be used as is known in the art, and other finishing operations can be used as is known in the art.

Furthermore, the web 10 or either of the ribbons 16, 18 can be printed with personalized information, by printing the personalized information with the web press 12 or by using a separate, but in-line, inkjet printer 34. (Alternatively, personalized information can be printed or otherwise placed on the packets 2.) Preferably, the upper ribbon 16 is printed with personalized information after it has been folded into a multi-ply ribbon, but printer 34 can be placed to apply this information at a different point in the system. Thus, in the example given above, the recipient may receive a packet advertising a health club, with a temporary membership card already containing the recipient's name and/or membership number. Or, a national health club may send packets with the location and contact information of the local franchise printed either on the removable portion 6 or on the main portion of the brochure 4.

Figure 3:
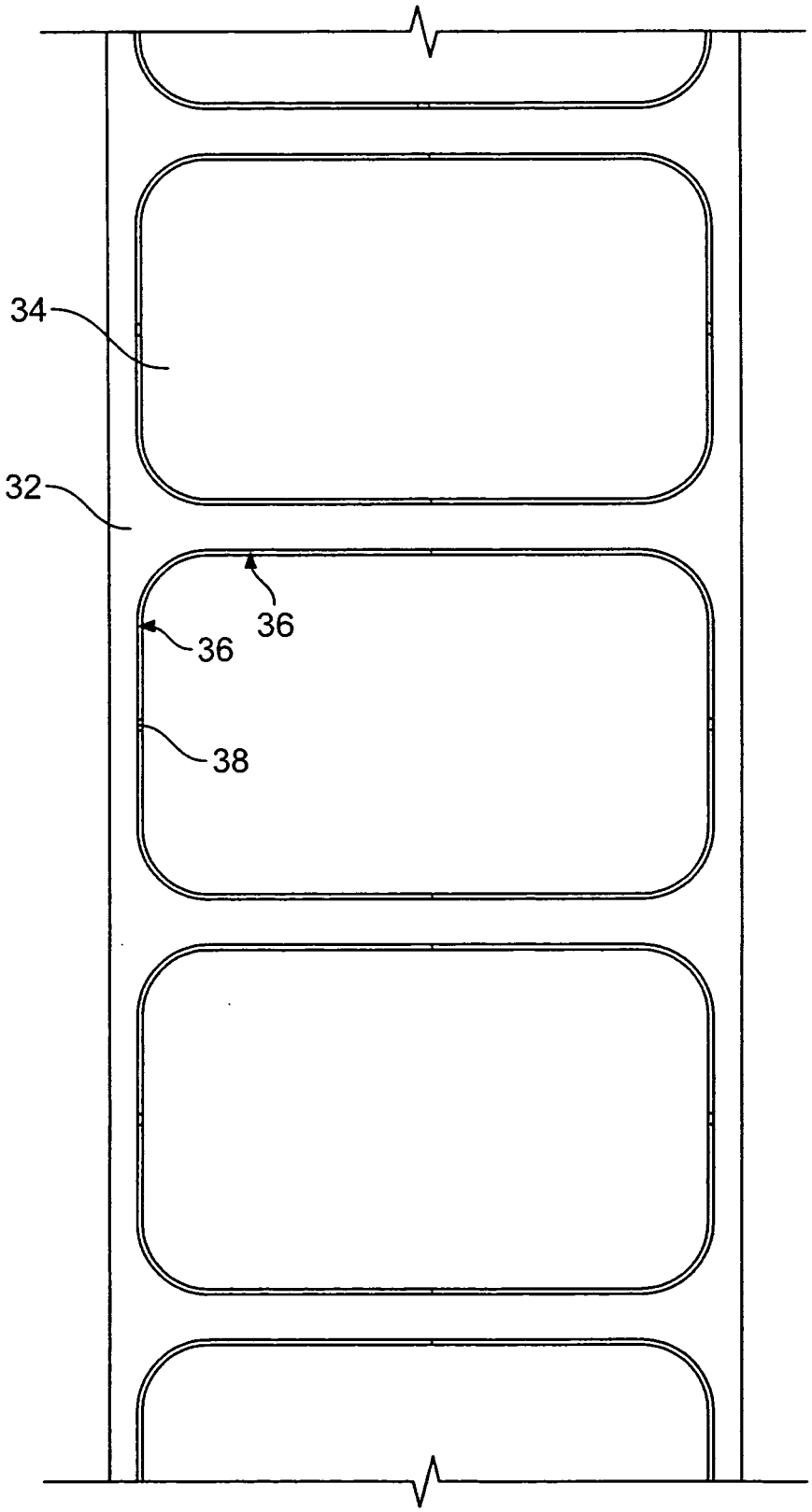
FIG. 3 is a plan view of the second ribbon of the preferred embodiment of the present invention, after cutting but before removal of the outer portion.

In the preferred embodiment, the upper ribbon 16 next enters a first rotary die cutter 36, which cuts the removable portions 6 in the upper ribbon 16. FIG. 3 shows a portion of the upper ribbon 16 of the preferred embodiment, having been die cut into an outside portion or matrix 38 and an inside portion 40, separated by die cuts 42. In the illustrated embodiment, the first rotary die cutter 36 cuts the removable portions 6 in a rectangular shape, such as for use as a removable card. First rotary die cutter 36 can cut removable portions 6 in any shape desired by the used, however, as is well known in the art of rotary die cutters. The upper ribbon 16, upon exiting first rotary die cutter 36, enters a set of marrying rollers 44 and 46.

The lower ribbon 18 proceeds to processing stations 20A, which perform various finishing operations. The lower ribbon 18 can be folded and glued as needed for the final packet 2, or other finishing operations can be used. The lower ribbon 18 can be cut and folded, for example, into a return envelope for the recipient to send back to order goods or services or otherwise reply to the information in the packet. Other finishing operations include but are not limited to aqueous coating, overall and spot UV coatings, film lamination, embossing, foil and hologram stamping, and post embossing.

The lower ribbon 18 is next brought over a reversing roller 48 and into the set of marrying rollers 44, 46. Before entering the marrying rollers 44, 46, a spot gluer 50 puts dabs of spot glue 8 on the lower ribbon 18, at those locations where the removable portions 6 will be. (Alternatively, the spot gluer could place the dabs of spot glue 8 on the upper ribbon 16.) The marrying rollers 44, 46 then marry the upper ribbon 16 to the lower ribbon 18. The upper ribbon 16 adheres to the lower ribbon 18 by means of the spot glue 8. The two ribbons 16, 18 then proceed together to a set of nip rollers 52, 54.

In the preferred embodiment, the position of marrying rollers 44 and 46 are situated so that the distance 58 from the knife point 56 of die cutter 36 to the rollers 44, 46 is less than the length of the inside portion 40. As the upper ribbon 16 exits the rotary cutter 30, the upper ribbon 16 proceeds into rollers 44, 46, so that inside portion 40 is never loose. In the preferred embodiment, the leading edge of each inside portion 40 contacts and rests upon the lower ribbon 18 at marrying rollers 44, 46 before the trailing edge of the inside portion 40 exits the knife point 56 of the rotary cutter 36.

After the now married upper ribbon 16 and lower ribbon 18 pass through the nip rollers 52, 54, a pulling roller 60 pulls the matrix 38 off the lower ribbon 18. An air jet 62 selectively shoots compressed air 64 at upper ribbon 16 but only at inside portion 40. The matrix 38 then is pulled off lower ribbon 18. Because of the spot glue 8 and the pressurized air 64 from air jet 62, the pulling action of pulling roller 60 separates the matrix 38 from inside portion 40. Inside portion 40, which at this point has become removable portion 6, stays married to the lower ribbon 18, rather than following the matrix 38, and the matrix or outer portion 38 is fed to a disposal system 66, preferably a vacuum disposal system.

The lower ribbon 18, now carrying the removable portions 6, proceeds to finishing stations 20B for further finishing by methods known in the art, including but not limited to further folding, aqueous coating, overall and spot UV coatings, film lamination, embossing, foil and hologram stamping, and post embossing, if desired. As illustrated, finishing stations 20B are located after upper ribbon 16 has been married to lower ribbon 18. In other embodiments, finishing stations 20B can be located elsewhere and finishing operations as described above can be performed elsewhere. For example, finishing operations can be performed on the web 10 before it is printed or after it is printed but before it is slit. Finishing operations can be performed on the upper ribbon 16 at any point after the creation of upper ribbon 16 at slitter 14. Finishing operations can be performed on the packets 2 after finishing rotary cutter 68 cuts them, as will be described.

In the preferred embodiment, lower ribbon 18, after proceeding through one or more finishing operations as desired in finishing stations 20B, then proceeds to finishing rotary cutter 68, which transversely cuts lower ribbon 18 into main portions 4.

Because the removable portions 6 are created from a ribbon running parallel to the ribbon from which the packets 2 are created, the alignment problems inherent in the "tip-on" process are greatly reduced.

In an alternative embodiment, upper ribbon 18 is printed on a first web 70 on web press 12 and lower ribbon 16 is simultaneously printed on second web 72 on the same web press 12. The two ribbons 16, 18 are thereafter processed as described above.

In another alternative embodiment, upper ribbon 16 is printed on a first web press 74 and processed as described above. In this embodiment, however, lower ribbon 18 is simultaneously printed on a second web press 76 and processed as described above. The two ribbons 16, 18 are thereafter married and processed as described above.

In yet another embodiment, a kiss cut is used to create the removable portions 6. (Kiss cutting is cutting through a first ribbon and not cutting through a second ribbon that has been married to the first ribbon.) In this embodiment, after the upper ribbon 16 has been folded and glued into a multi-ply ribbon, as described above, upper ribbon 16 is married to lower ribbon 18 by marrying rollers 44, 46. First die cutter 36 performs a kiss-cut to create the removable portions 6 in the upper ribbon 16, by cutting the upper ribbon 14 into an outside portion or matrix 38 and an inside portion 40, separated by cuts 42. Because a kiss cut is made, the cuts 42 do not extend into the lower ribbon 18. Pulling roller 60 pulls the matrix 38 off upper ribbon 16 as described above and the lower ribbon 18, now carrying the removable portions 6, proceeds for further finishing as described above.

In yet another embodiment, separate ribbons are glued together to create a multi-ply ribbon. In this embodiment, slitter 14 creates two upper ribbons 16 and 16'. Glue is applied to at least one of the upper ribbons 16 and 16' by applicator 26 and upper ribbons 16 and 16' are married to create a multi-ply ribbon (in this case, a two-ply ribbon). That multi-ply ribbon is married to lower ribbon 18 as described above.

In yet another embodiment, a combination of folding and separate ribbons are used. To create, for example, a three-ply removable portion, slitter 14 creates two upper ribbons 16 and 16', where upper ribbon 16 is approximately twice the width of upper ribbon 16'. Upper ribbon 16 is then glued at applicator 26 and folded at plow 30. Upper ribbon 16' is sandwiched into upper ribbon 16 during the folding operation, to create a three-ply ribbon. That three-ply ribbon proceeds to be married to lower ribbon 18 as described above. Thus, a packet 2 may have a main portion 4 that is a brochure printed on seven-point paper, with a removable portion 6 that appears to be 21-point paper, even though the removable portion 6 was printed on the same seven-point paper as the main portion 4.

Figure 4:
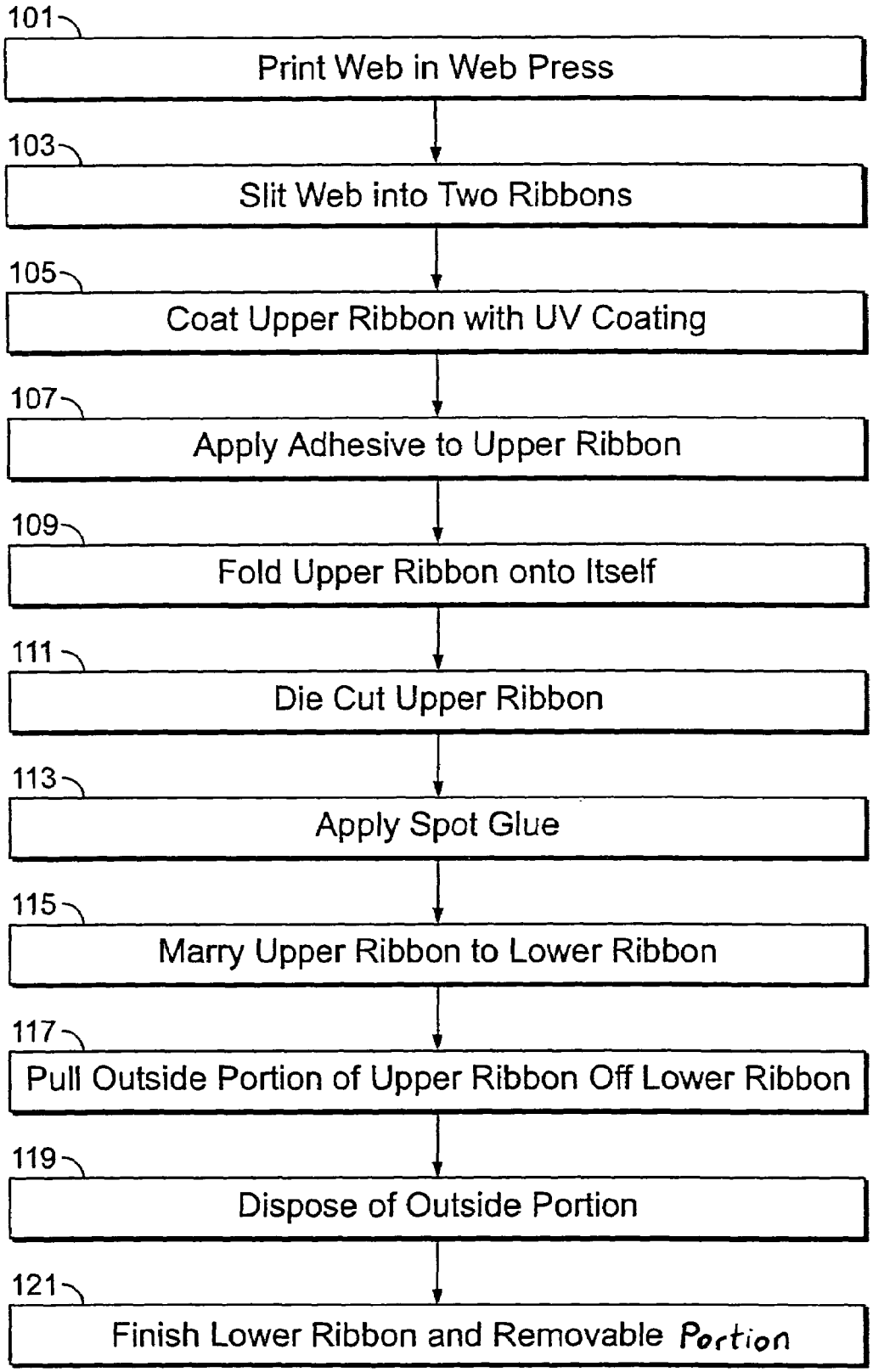
FIG. 4 is a block diagram of the method of the preferred embodiment of the invention.
Figure 5:
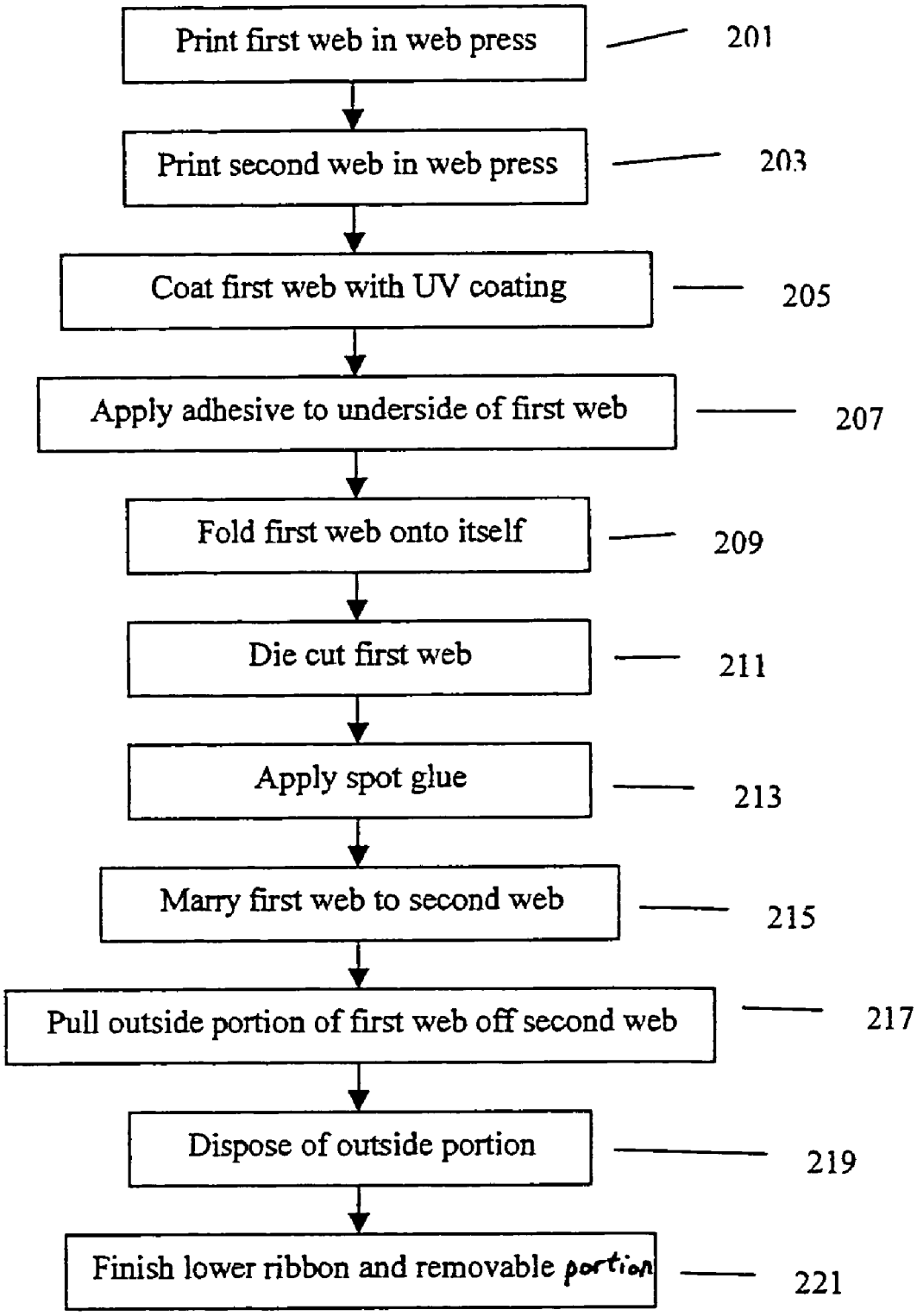
FIG. 5 is a block diagram of the method of another embodiment of the invention.
Figure 6:
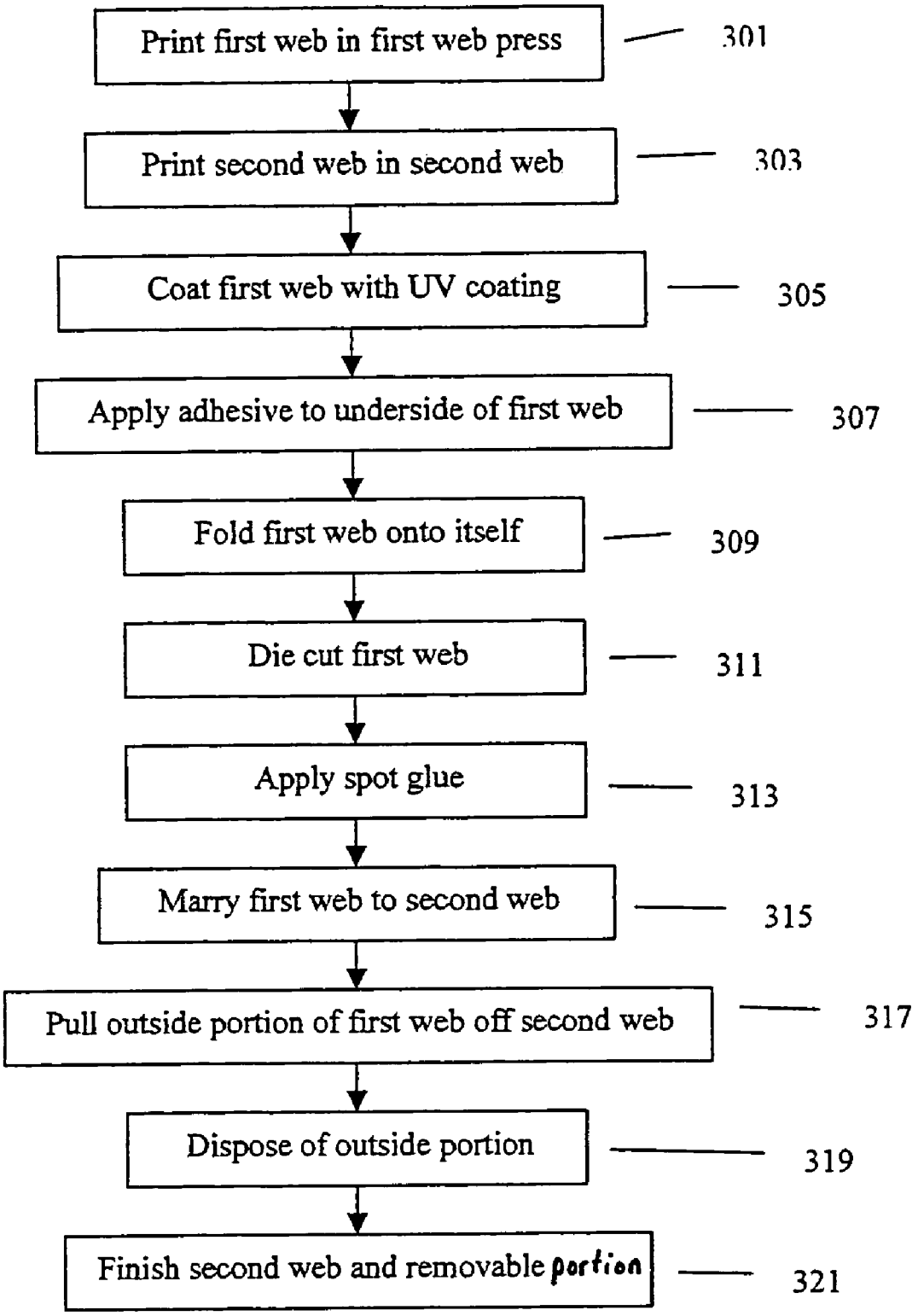
FIG. 6 is a block diagram of the method of yet another embodiment of the invention

The method of the preferred embodiment of the present invention is diagramed in FIG. 4 and consists of the following steps, which preferably are performed in this order:

1. Printing a web 101;
2. Slitting the web into an upper and lower ribbon 103;
3. Coating the upper ribbon with UV coating 105;
4. Applying adhesive to upper ribbon 107;
5. Folding the upper ribbon onto itself 109;
6. Die cutting the upper ribbon 111;
7. Applying spots of glue, preferably to the lower ribbon 113;
8. Marrying the upper ribbon to the lower ribbon 115;
9. Pulling the matrix of the upper ribbon off the lower ribbon 117;
10. Disposing of the matrix 119;
11. Finishing the lower ribbon and removable portions 121.

Please note that these steps may be performed in different order without departing from the present invention. For example, coating step 105 can be performed at various points in the process. Additionally, the step of printing personalized information on either the web, one of the ribbons, or the packets, may be inserted at various points of the process.

The method of the alternative embodiment in which two webs are printed on a single web press is:

1. Printing a first web on a web press 201;
2. Printing a second web on the same web press 203;
3. Coating the first web with UV coating 205;
4. Applying adhesive to the first web 207;
5. Folding the first web onto itself 209;
6. Die cutting the folded first web 211;
7. Applying spots of glue, preferably to the second web 213;
8. Marrying the first web to the second web 215;
9. Pulling the matrix of the first web off the second web 217;
10. Disposing of the matrix 219.
11. Finishing the second web and removable portions 221.

Again, these steps may be performed in different order without departing from the present invention. For example, coating step 205 can be performed at various points in the process. Additionally, the step of printing personalized information on either of the first or second webs, or on the packets, may be inserted at various points of the process.

The method of the alternative embodiment in which two webs are printed on a two separate, preferably parallel, web presses is:

1. Printing a first web on a first web press 301;
2. Printing a second web on a second web press 303;
3. Coating the first web with UV coating 305;
4. Applying adhesive to the first web 307;
5. Folding the first web onto itself 309;
6. Die cutting the folded first web 311;
7. Applying spots of glue, preferably to the second web 313;
8. Marrying the first web to the second web 315;
9. Pulling the matrix of the first web off the second web 317;
10. Disposing of the outside portion 319;
11. Finishing the second web and removable portions 321.

Please note that these steps may be performed in different order without departing from the present invention. For example, coating step 105 can be performed at various points in the process. Additionally, the step of printing personalized information on either the web, one of the ribbons, or the packets, may be inserted at various points of the process.

The method of yet another alternative embodiment of the present invention, in which a kiss cutter is used instead of a die cutter, consists of the following steps:

1. Printing a web 401;
2. Slitting the web into an upper and lower ribbon 403;
3. Coating the upper ribbon with UV coating 405;
4. Applying adhesive to the upper ribbon 407;
5. Folding the upper ribbon onto itself 409;
6. Applying spots of glue, preferably to the lower ribbon 413;
7. Marrying the upper ribbon to the lower ribbon 415;
8. Kiss cutting the upper ribbon with a die cutter 417;
9. Pulling the matrix of the upper ribbon off the lower ribbon 419;
10. Disposing of the outside portion 421;
11. Finishing the lower ribbon and removable portions 423.

Please note that these steps may be performed in different order without departing from the present invention. For example, coating step 405 can be performed at various points in the process. Additionally, the step of printing personalized information on either the web, one of the ribbons, or the packets, may be inserted at various points of the process. Moreover, the step of kiss cutting the portions out of the upper ribbon after the upper ribbon and lower ribbon have been married can be made regardless of whether the two ribbons were created from one web on one web press, two webs on one web press, or two webs on two web presses. Additionally, the step of kiss cutting the removable portions out of the upper ribbon after the upper ribbon has been married to the lower ribbon can be made regardless of whether the multi-ply ribbon was made by folding a ribbon upon itself, by gluing together two or more separate ribbons, or by a combination of folding one ribbon and gluing one or more ribbons.

Please note also the steps of pulling off the matrix 38 (steps 117, 217, 317, and 419) and disposing of the matrix 38 (steps 119, 219, 319, and 421) are optional. For some removable portion applications, the advertiser may choose to leave the matrix 38 attached to the lower ribbon 18. The recipient can then peel the removable portion 6 off the lower ribbon 18.

While preferred embodiments of the present invention are shown and described, it is envisioned that those skilled in the art may devise various modifications of the present invention.

What is claimed is:

1. A method of making a distributable packet including a removable portion, in a continuous, single-path finishing system, comprising:

printing a web;

slitting said web into at least a first ribbon, a second ribbon, and a third ribbon;

gluing said first ribbon to said second ribbon to form a multi-ply ribbon;

cutting said multi-ply ribbon into a plurality of removable portions;

marrying said multi-ply ribbon to said third ribbon;

cutting said third ribbon into packets.

2. The method of claim 1, further comprising applying a coating to at least one of said first ribbon and said second ribbon.

3. The method of claim 1, further comprising printing personalized information on at least one of said first ribbon, said second ribbon, said third ribbon, said web, and said packets.

4. The method of claim 1, wherein said cutting said multi-ply ribbon step comprises die cutting said multi-ply ribbon to create an outside portion.

5. The method of claim 4, further comprising removing said outside portion.

6. The method or claim 5, wherein said removing step comprises pulling said outside portion with a pulling roller.

7. The method of claim 1, wherein said cutting said multi-ply ribbon step comprises kiss-cutting said multi-ply ribbon to create an outside portion.

8. The method of claim 7, further comprising removing said outside portion.

9. The method of claim 8, wherein said removing step comprises pulling said outside portion with a pulling roller.

10. The method of claim 1, further comprising finishing at least one of said first ribbon, said second ribbon, said multi-ply ribbon, said web, and said third ribbon before said marrying step.

11. The method of claim 1, further comprising finishing at least one of said first ribbon, said second ribbon, said multi-ply ribbon, said web, and said third ribbon after said marrying step.

12. A method of making a distributable packet including a removable portion, in a continuous, single-path finishing system, comprising:

printing a first web on a web press;

printing a second web on said web press;

slitting said second web into at least a first ribbon and a second ribbon;

gluing said first ribbon to said second ribbon to form a multi-ply ribbon;

cutting said multi-ply ribbon into a plurality of removable portions;

marrying said multi-ply ribbon to said first web;

cutting said first web into packets.

13. The method of claim 12, further comprising applying a coating to at least one of said first ribbon, said second ribbon and said multi-ply ribbon.

14. The method of claim 12, further comprising printing personalized information on at least one of said first ribbon, said second ribbon, said multi-ply ribbon, said first web, and said packets.

15. The method of claim 12, wherein said cutting said multi-ply ribbon web step comprises die cutting said multi-ply ribbon to create an outside portion.

16. The method of claim 15, further comprising removing said outside portion.

17. The method of claim 16, wherein said removing step comprises pulling said outside portion with a pulling roller.

18. The method of claim 12, wherein said cutting said multi-ply ribbon step comprises kiss-cutting said multi-ply ribbon to create an outside portion.

19. The method of claim 18, further comprising removing said outside portion.

20. The method of claim 19, wherein said removing step comprises pulling said outside portion with a roller.

21. The method of claim 12, further comprising finishing at least one of said first web, said second web, said first ribbon, said second ribbon, and said multi-ply ribbon before said marrying step.

22. The method of claim 12, further comprising finishing at least one of said first web, said second web, said first ribbon, said second ribbon, and said multi-ply ribbon after said marrying step.

* * * * *